United States Patent [19]

Gerber

[11] Patent Number: 4,879,935

[45] Date of Patent: Nov. 14, 1989

[54] RECIPROCATING KNIFE CUTTER WITH FLEXIBLE DRIVE PORTION

[75] Inventor: Heinz J. Gerber, West Hartford, Conn.

[73] Assignee: Gerber Scientific, Inc., South Windsor, Conn.

[21] Appl. No.: 156,835

[22] Filed: Feb. 17, 1988

[51] Int. Cl.[4] ..... B26D 1/10; B26D 7/26; D06H 7/00

[52] U.S. Cl. ..... 83/748; 83/528; 83/628; 83/632; 83/747; 83/939; 30/272.1

[58] Field of Search ..... 83/748, 747, 528, 632, 83/925 CC; 30/392, 394, 272

[56] References Cited

U.S. PATENT DOCUMENTS

| | | | |
|---|---|---|---|
| 1,793,053 | 2/1931 | Cahill et al. | 30/394 |
| 2,764,188 | 9/1956 | Hoffman | 30/392 |
| 3,513,544 | 5/1970 | Renger | 30/272 |
| 3,955,458 | 5/1976 | Pearl | 83/528 |
| 4,033,214 | 7/1977 | Pearl | 83/174 |
| 4,048,891 | 9/1977 | Pearl | 83/628 |

*Primary Examiner*—Donald R. Schran
*Attorney, Agent, or Firm*—McCormick, Paulding & Huber

[57] ABSTRACT

A cutter in which a reciprocating knife is driven by an eccentric mechanism. The knife has a drive portion that flexes laterally in a plane perpendicular to the drive axis of the eccentric mechanism. The eccentric drive axis is offset along the perpendicular plane away from the axis on which the knife reciprocates. The offset of the eccentric drive axis allows the flexible drive portion to be kept straighter during the downstroke than in previous cutters. The increased straightening provides greater columnar strength and reduces deflection and stress of the drive portion during the time the knife is in compression. During the upstroke the knife is bent to a greater degree than in the previous cutters, but during this time the knife is in tension, the tension forces opposing rather than aiding the bending. The offset therefore provides for a longer service life for a blade of equal size or allows a reduction in size and mass of the knife to maintain an equivalent service life.

5 Claims, 5 Drawing Sheets

RECIPROCATING KNIFE CUTTER WITH FLEXIBLE DRIVE PORTION

BACKGROUND OF THE INVENTION

This invention relates to reciprocating knife cutters of the type wherein the knife includes a lower cutting portion having at least one sharp cutting edge and is driven by an eccentric mechanism through an upper laterally flexible drive portion or member connected at its lower end to the cutting portion of the knife and at its upper end to the eccentric mechanism so that the lateral component of movement of the eccentric axis is accommodated by lateral flexing of such upper portion, thereby eliminating otherwise needed pivot joints between the eccentric axis and the cutting portion, and deals more particularly with an improvement in such a cutter increasing the ability of the flexible drive portion to withstand the forces imposed thereon during a cutting process and otherwise enhancing the cutter's performance.

A reciprocating knife cutter of the type to which the invention generally pertains is shown, for example, in U.S. U.S. Pat. No. 4,033,214 and in U.S. patent application Ser. No. 06/861,148, filed May 8, 1986, by the same inventor as this application and entitled "CUTTER HEAD AND KNIFE FOR CUTTING SHEE MATERIAL". Another such cutter is shown in U.S. Pat. No. 3,513,444. Such a cutter includes a reciprocating knife, either made as an assembly of parts, as in U.S. Pat. No. 3,513,444 and in U.S. Pat. No. 4,033,214, or made as a one-piece member, as in patent the aforesaid cutting portion and drive portion are integrally joined and made of one piece of material, is the presently preferred embodiment and is shown and described herein by way of example. However, the invention, at least in its broader aspects, also extends to situations where the cutting portion and flexible drive portion are initially separate parts subsequently connected to one another for use in the cutter.

The cutters of the aforesaid patents and patent application are described as being used for cutting cloth or similar sheet material. In the drawings and description which follows the cutter of this invention is likewise described as one usable for cutting cloth, but the invention is also not limited to such application and may instead find use in cutters for cutting various other materials.

A general object of the invention is to provide a cutter of the aforegoing character wherein, in comparison to known cutters of the same general type, the ability of a given flexible knife driving portion to withstand the forces imposed on it during operation is increased to yield a longer service life or, alternatively, the flexible knife driving portion may be made smaller and/or of less mass than previously while nevertheless retaining a service life generally equal to that of previous driving portions.

SUMMARY OF THE INVENTION

The invention involves a reciprocating knife cutter including a knife having a lower cutting portion supported by guide means for reciprocation along a vertical guide axis. An eccentric mechanism is located above the guide means and includes an eccentric drive member rotatable about a horizontal drive axis fixed relative to the guide means. A resiliently flexible drive portion or member is connected to and extends upwardly from the upper end of the lower knife portion, and is connected at its own upper end to the eccentric drive member for rotation relative to the drive member about an eccentric axis fixed to the drive member and radially spaced from and parallel to the horizontal drive axis of the drive member. Therefore, as the drive member rotates the flexible drive portion is reciprocated vertically to reciprocate the lower portion of the knife and is also flexed laterally to accommodate the horizontal component of motion of the eccentric axis.

The invention resides particularly in the fact that in an apparatus of the foregoing character the rotational axis of the drive member is spaced horizontally a substantial distance from the reciprocating axis of the cutting portion of the knife with the result that the flexure of the flexible drive portion during its downstroke is different from its flexure during its upstroke.

The invention further resides in the fact that the direction of rotation of the drive member and the direction of offset of the rotational axis of the drive member from the reciprocation axis are so related that during its downstroke the flexure of the flexible drive portion is less than it is during its upstroke. Therefore, during its downstroke, when in compression and usually more heavily loaded than during its upstroke, the flexible drive portion is straighter than in previous cutters and accordingly has a significantly greater column strength causing it to deflect less under the compressive loads applied to it, thereby giving it a longer service life by making it more resistant to fatigue fractures or other failures, or allowing it, for an equivalent service life, to be made of thinner section and less mass.

DETAILED DESCRIPTION OF THE PREFERRED EMBODIMENT

Figure 1:
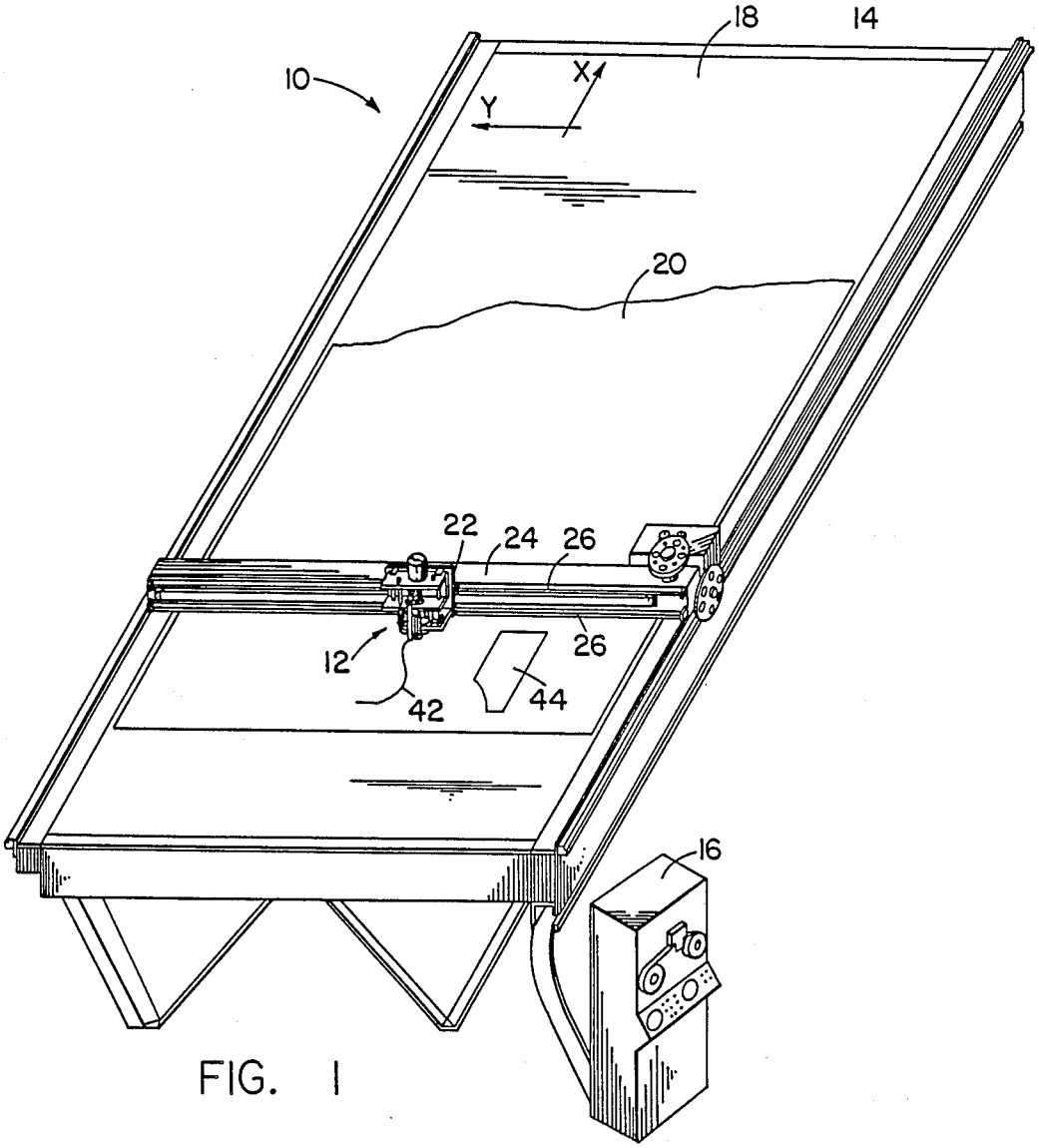
FIG. 1 is a perspective view of a cloth cutting machine including a reciprocating knife cutter embodying this invention.

FIG. 1 shows a cloth cutting machine, indicated generally at 10, having a cutter head, indicated generally at 12, embodying the present invention. For convenience, the machine 10 and cutting head 12 are, except for the difference described below, taken to be similar to the machine and cutter head shown in presently pending application Ser. No. 861,148 filed May 8, 1986, to which reference may be made for further details of their construction and operation. For the present purposes, it is sufficient to note that the cutting machine 10, in addition to the cutter head 12 includes a cutting table 14 and a controller 16. The table 14 has an elongated, rectangular, horizontal and upwardly facing work support surface 18 for supporting sheet material to be cut in a spread condition. One sheet of such material is shown at 20. A vacuum system which is not shown but which may, for example, be similar to the one shown in Pat.

No. 4,587,873 is preferably associated with the table to aid in holding in place and compacting the material to be cut. The material forming the work surface 18 of the table is one which allows the knife of the cutter head to penetrate into it during a cutting operation. This material may vary widely, but preferably it consists of a plurality of bristle elements or blocks fitted together to form a continuous bristle bed, as in the aforementioned U.S. Pat. No. 4,587,873.

A part of the cutter head 12 is a tool carriage 22 supported on an X-carriage 24 by two guide bars 26, 26 for movement in the illustrated Y-coordinate direction. At each of its opposite ends the X-carriage 24 is guided for movement relative to the table 14 in the illustrated X-coordinate direction. Suitable drive motors, and associated drive trains, under the control of the controller 16 move the tool carriage 22 and X-carriage 24. Thus, by combined movement of the X-carriage 24 in the X-coordinate direction and the tool carriage 22 in the Y-coordinate direction the cutter head 12 may be made to follow any desired line of cut on the sheet 20 to cut pattern parts or other similar components from the sheet, one such line of cut being indicated at 42 and one such pattern piece being indicated at 44.

Figure 2:
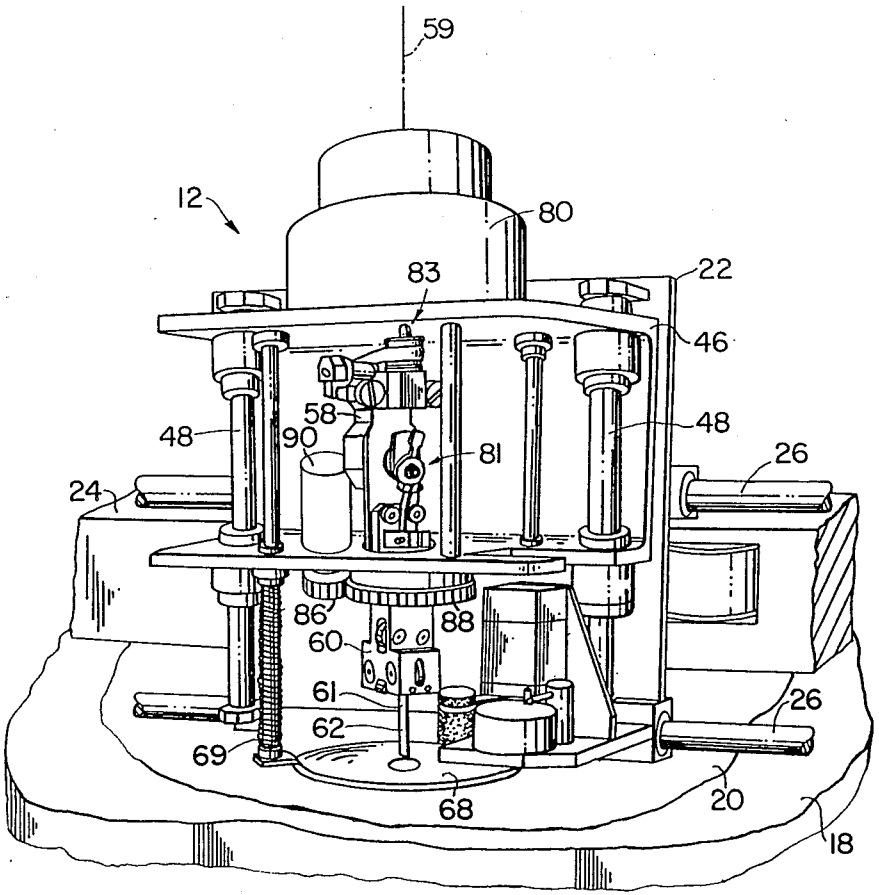
FIG. 2 is a fragmentary enlarged perspective view of the cutter of FIG. 1.

As shown best in FIG. 2 the cutter head 12 includes a base frame 46 supported for vertical movement relative to the tool carriage by two guide rods 48, 48. FIG. 2 shows the base frame 46 in its raised or non-cutting position relative to the tool carriage 22, from which position it may be lowered, by sliding on the rods 48, 48 and by operation of a pneumatic actuator or similar motor (not shown), to a lowered cutting position.

A knife frame 58 is carried by the base frame 46 for rotation relative to the base frame about a vertical axis 59. The knife frame 58 in turn has fixed to it a guide 60 which engages the lower portion 61 of a knife 62 and restrains it to vertical reciprocating motion along the axis 59. A presser foot 68 is supported on the base frame 46 for vertical sliding movement relative to the base frame and is biased by one or more springs, such as the one shown at 69, to its lowermost position. When the frame 46 is lowered from its FIG. 2 position to a cutting position, the presser foot after engaging the material to be cut has its downward movement stopped by the material to be cut so that the base frame 46 thereafter moves downwardly relative to the presser foot against the force of the biasing spring or springs 69 with the knife 62 then moving through the center of the presser foot 68 and into cutting relationship with the material 20.

The motor 80 for driving the knife 62 in its reciprocating motion is mounted on the base frame 46 and is drivingly connected with an eccentric mechanism, indicated generally at 81, carried by the knife frame 58 through a pulley and belt drive train, indicated generally at 83, which allows the knife frame 58 to rotate about the axis 59 relative to the base frame 46 and motor 80 while nevertheless delivering power from the motor 80 to the eccentric drive mechanism 81 at all angular positions of the knife frame 58 about the axis 59. The knife frame 58 is positioned about the axis 59, under the control of the controller 16, by a motor 90 carried by the base frame 46 and drivingly connected with the knife frame 58 through gears 86 and 88.

As seen in FIGS. 4 to 9 the knife 62 has, as mentioned, a lower portion 61 which along at least a part of the length of its forward edge is sharpened to provide a cutting edge 63 for cutting the material 20 as it is vertically reciprocated and moved along a line of cut. The lower knife portion 61 is further restrained by the guide 60 to vertical reciprocating movement along the vertical axis 59. The guide 60 has suitable means engaging the knife for this purpose, such means in the illustrated case including a plurality of rollers, 91, 92 engaging the side faces of the knife, at least one roller 94 engaging the rear edge of the knife and at least one other roller (not shown in FIGS. 4 to 9) engaging the front edge of the knife.

The knife 62 also includes an upper or drive portion 96 which extends upwardly from the guide 60 to the eccentric mechanism 81. Preferably, and as shown, the drive portion 96 of the knife is of one piece with the lower knife portion 61 and the upper end of the drive portion 96 is releasably connected to the eccentric mechanism 81 so that when making a knife replacement the entire knife, including both the lower portion 61 and the upper or drive portion 96, is removed and replaced by a similar new knife including both a lower portion 61 and drive portion 96. As mentioned, however, the invention is not limited to this particular construction and in some cases the drive portion 96 may be made as a separate member releasably connected to the lower portion 61 which forms another separate member, thereby allowing the lower portion to be removed and replaced from and into the cutter without at the same time removing and replacing the drive portion 96.

The illustrated drive portion 96 is laterally flexible, that is, flexible in the plane of the paper in FIGS. 4 to 9, so that its upper end is moveable laterally to accommodate the horizontal component of motion of the eccentric mechanism. In FIGS. 4 to 9 the drive portion 96 has been shown as having the same thickness as the lower portion 61, but if desired the thickness of the drive portion may differ from that of the lower portion and, if desired, it may, for example, be given a tapering thickness such as disclosed in copending patent application Ser. No. 861,148.

Between the guide 60 and the eccentric mechanism 81 the knife frame 58 carries two rollers 98, 98 positioned on opposite sides of the drive portion 96 of the knife and located so that one roller 98 engages the drive portion 96 during a portion of its downstroke and the other roller 98 engages the portion 96 during a part of its upstroke, to thereby function as vibration inhibiting or reducing stops. Such stops are not, however, necessary to the broader aspects of the present invention and may in some applications be omitted.

Figure 3:
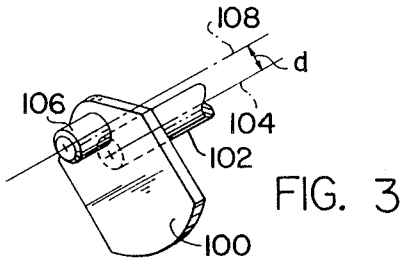
FIG. 3 is a fragmentary perspective view of the eccentric drive member of the cutter of FIG. 1.

As shown best in FIG. 3, the eccentric mechanism 81 includes an eccentric drive member 100 having a drive shaft portion 102 is supported by the knife frame 58 for rotation about a horizontal drive axis 104 fixed relative to the knife frame 58. The eccentric drive member 100 also includes an eccentric part in the form of a stub shaft 106 having a central axis 108, constituting the eccentric axis of the eccentric mechanism, which eccentric axis 108 is fixed relative to the eccentric member 100, is parallel to the drive axis 104 and is spaced from the drive axis by the distance d. As shown in FIGS. 4 to 9, the eccentric stub shaft 106 rotatably carries a chuck 110, axially retained on the stub shaft by a spring clip 112, which is releasably connected with the upper end of the drive portion 96 of the knife by a screw 114 which fits through an opening in the upper end of the drive portion 96 and is threadably received by a part of the chuck.

In accordance with the invention, the drive axis 104 of the eccentric mechanism is horizontally displaced to one side of the axis 59 along which the lower portion of the knife reciprocates. This offset of the drive axis 104 from the axis 59 may vary, but preferably it is exactly or close to one half of the spacing d of the eccentric axis 108 from the drive axis 104, and is shown as being d/2 in FIGS. 5 to 9.

As a result of this horizontal offset of the eccentric drive axis from the reciprocation axis, the upper or drive portion 96 of the knife flexes differently during its downstroke than it does during its upstroke. Indeed, during one of its strokes, the upper portion is deflected only moderately and retains a close to straight line shape, whereas in its other stroke it is bent more severely and departs considerably from a straight line.

In further accordance with the invention the direction of rotation of the eccentric member 100 is so chosen in relation to the direction of displacement of the eccentric drive axis from the reciprocation axis that the downstroke of the drive portion 96 is the stroke during which the drive portion retains its nearly straight line shape while the upstroke is the stroke during which it is deflected more severely. Since the downstroke of the drive portion is the one during which it is in compression and usually subjected to higher operating forces and is also the one during which the driving portion is straighter and has greater column strength, it is better able to withstand the compressive loads imposed on it. On the other hand, during its upstroke the tension applied to the driving portion tends to straighten it rather than to increase its bending. The net effect of this is that the driving portion 96 is stressed much less than it would be if the drive axis 104 of the eccentric member were located to intersect the reciprocation axis 59 as has been the case with known previous flexible knife cutters.

FIGS. 4 to 9 illustrate the effect of the offset of the drive axis 104 from the reciprocation axis 59 by showing the eccentric drive member 100 in different successive positions about the drive axis 104. As shown in these figures the drive axis 104 is displaced to the right of the reciprocation axis 59 by a distance d/2 where d is the displacement between the drive axis 104 and the eccentric axis 108. The illustrated vertical line 116 is the one passing through the drive axis 104. Further, the eccentric member 100 rotates counterclockwise as shown by the arrow 118.

Figure 4:
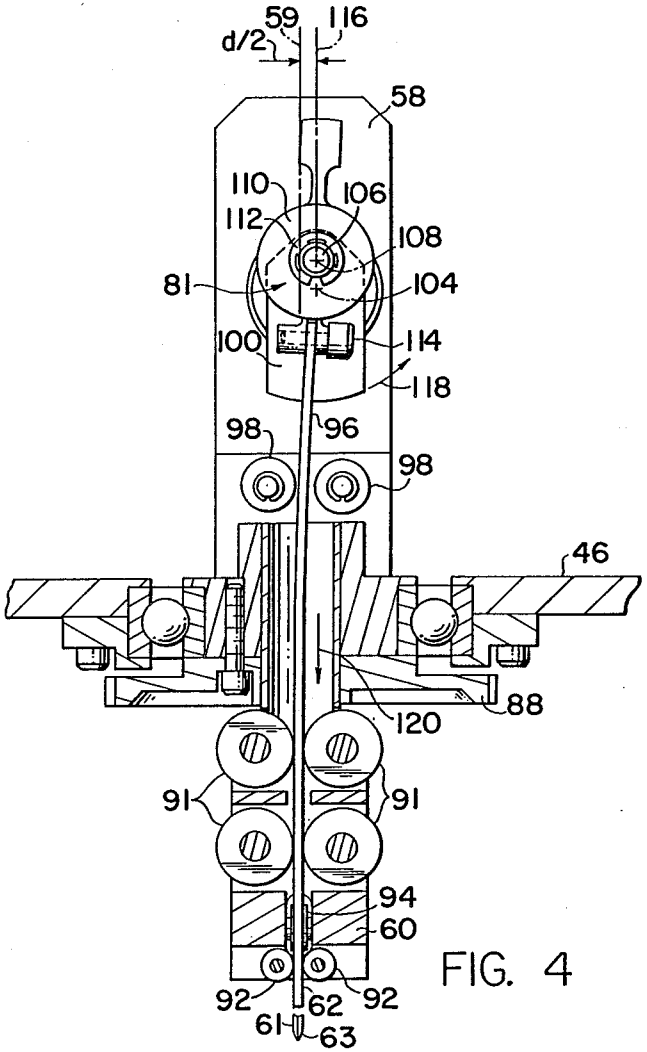

FIG. 4 shows the parts in the positions occupied when the eccentric axis 108 is located on the same vertical line 116 as the drive axis 104. In this position of the eccentric drive member 100 the knife 62 is at the top of its upstroke and is about to begin its downstroke, and it will be observed that the top of the knife, that is the top of its driving portion 96, is deflected somewhat to the right of the reciprocation axis 59 but the bending of the drive portion 96 is relatively moderate, departing only slightly from its unflexed straight line condition.

Figure 5:
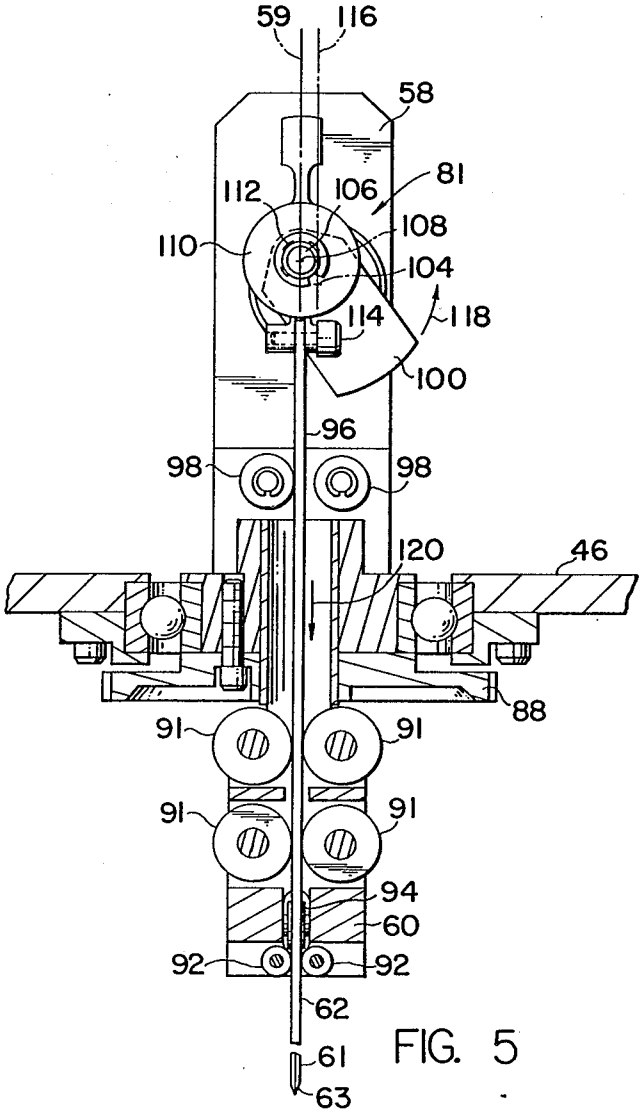
FIGS. 4, 5, 6, 7, 8 and 9 are views partly in elevation and partly in vertical section showing the knife, the knife guide and the knife driving mechanism of the cutter of FIG. 1, all of these views being identical except for showing the eccentric drive member in different positions about its rotational axis.

FIG. 5 shows the eccentric member 100 rotated from its FIG. 4 position to the position at which the eccentric axis 108 intersects the reciprocation axis 59. At this point the knife 62 is in the course of its downstroke, as illustrated by the arrow 120, and the knife 62 throughout its length is in a straight line or unflexed condition coinciding with the axis 59.

Figure 6:
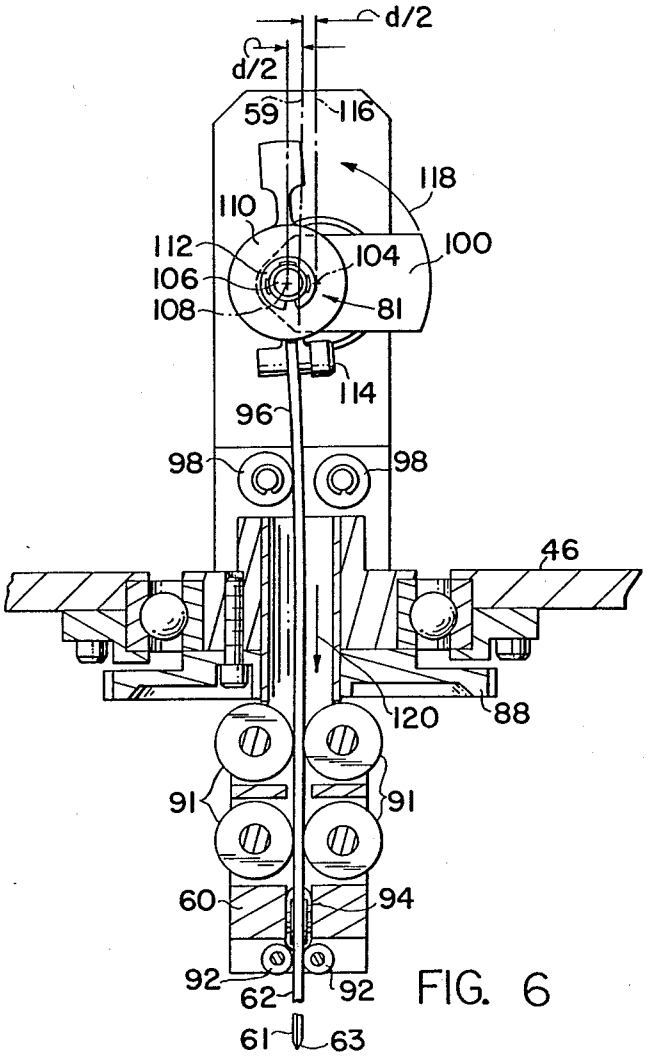

FIG. 6 shows the eccentric drive member 100 rotated from its FIG. 5 position to the position at which the eccentric axis 108 intersects the horizontal line 122 passing through the drive axis 104. The line 124 is the vertical one passing through the eccentric axis 108. At this point the top end of the knife is deflected slightly to the left of the reciprocation axis 59; but again, as in FIG. 4, the deflection is relatively moderate with the knife along its length departing not far from its unflexed straight line condition. At this point, the knife 62 is still in the course of its downstroke 120.

Figure 7:
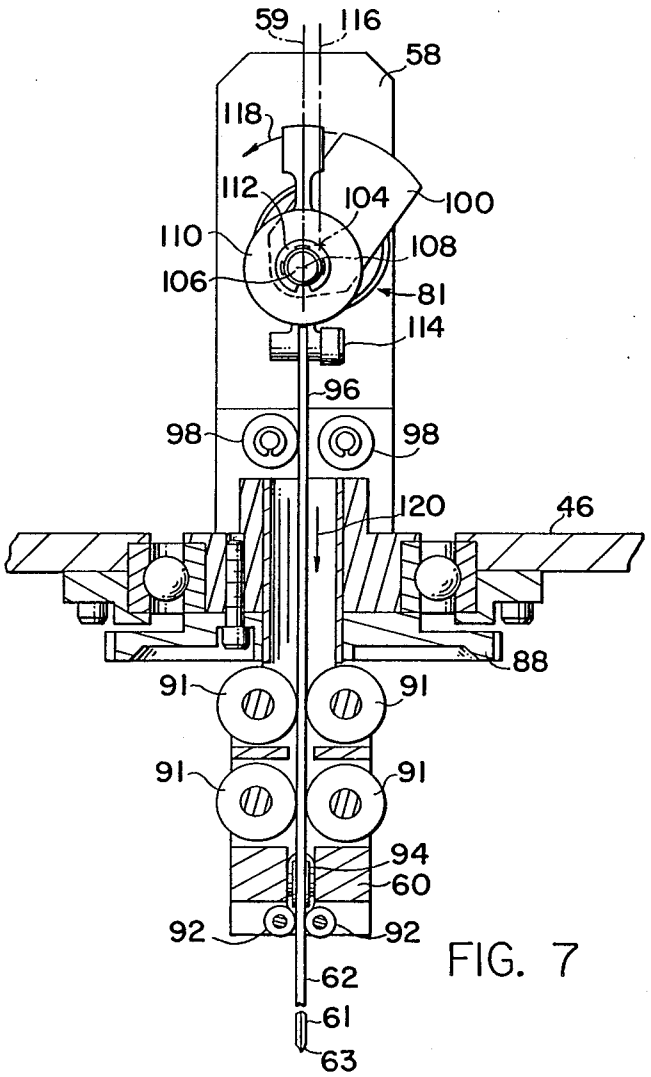

FIG. 7 shows the eccentric member 100 rotated to the position at which the eccentric axis 108 again intersects the reciprocation axis 59. At this point the knife 62 is still in the course of its downstroke and is again in an unflexed straight line condition similar to that of FIG. 5.

Figure 8:
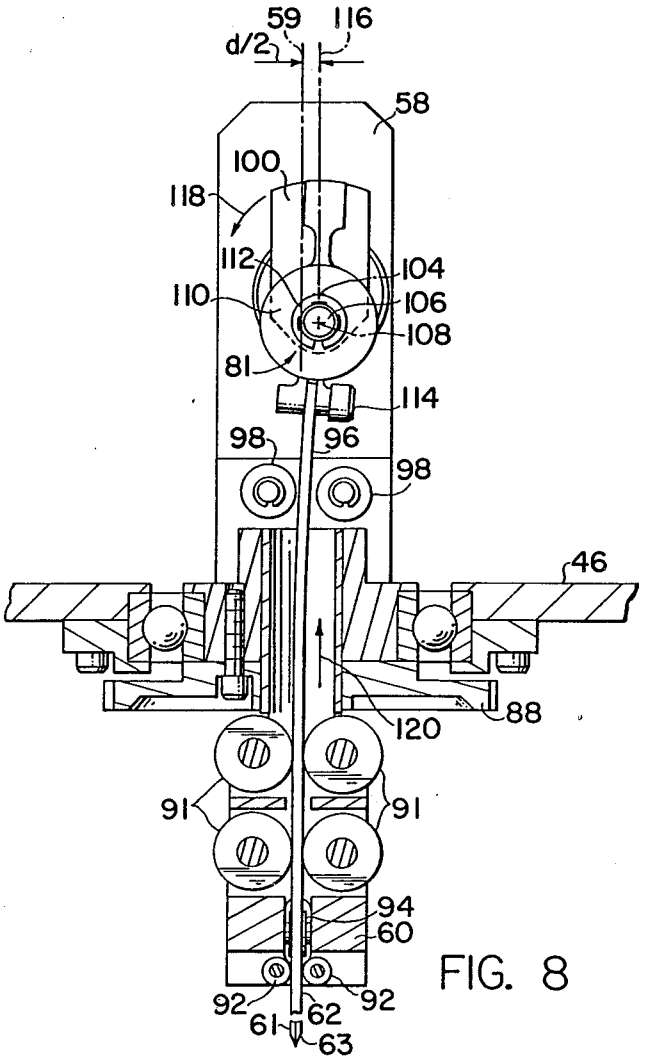

FIG. 8 shows the parts in the positions occupied when the eccentric drive member 100 is rotated from the FIG. 7 position to the position at which the eccentric axis 108 again falls on the vertical line 116 passing through the drive axis 104. This point marks the end of the knife's downstroke and the beginning of its upstroke with the knife being at its lowermost position. Also at this point it will be observed that the upper end of the knife is again slightly deflected to the right of the reciprocation axis 59 and only moderately bent away from a straight line condition. It will also be understood that FIGS. 4, 6, and 8 show the maximum deflections of the knife during its downstroke with the eccentric axis 108 in each of these cases being laterally displaced from the reciprocation axis 59 by the distance d/2.

Figure 9:
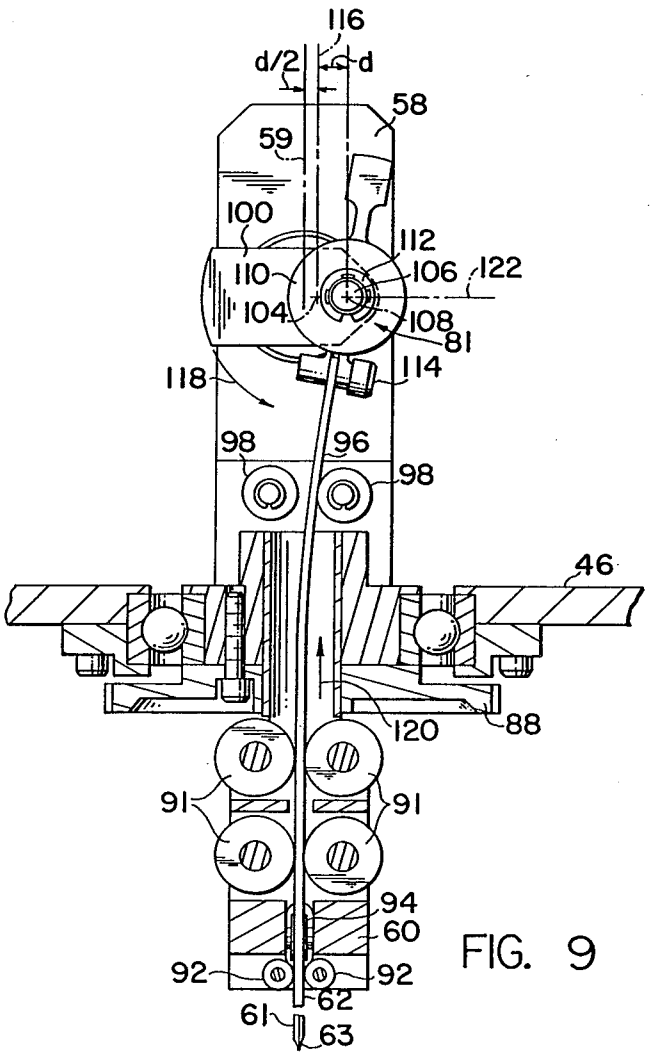

From the position of FIG. 8, the eccentric drive member 100 rotates counterclockwise back to the position of FIG. 4 and during this rotation the knife is moved through its upstroke. FIG. 9 shows the parts at the positions occupied at the point where the upper or drive portion 96 of the knife undergoes its maximum deflection during the upstroke. This point is that at which the eccentric axis 108 is located on the horizontal line 122 passing through the drive axis 104. Here the eccentric axis 108 is spaced from the axis of reciprocation by the distance 3d/2 which means the maximum deflection of the blade is approximately three times its maximum downstroke deflection.

Since during the upstroke of the knife the loading in the drive portion 96 is in tension the loading tends to resist or work against the bending of the blade, whereas if the loading were compressive its tendency would be to further bend or buckle the blade. On the other hand during the downstroke the loading in the drive portion 96 is compressive, but due to the significantly reduced bending of the drive portion during its downstroke column bending moments are kept reasonably small with the result that the compressive loading causes little increased bending or buckling of the drive portion.

I claim:

1. A reciprocating knife cutter comprising;

an elongated knife having a lower part with a sharpened edge extending along at least a portion of the length thereof, a frame, means carried by said frame engaging said lower knife portion and restraining it to reciprocating movement along a straight vertical axis of reciprocation fixed relative to said frame, an eccentric drive member supported on said frame for driving rotation about a horizontal drive axis fixed relative to said frame, and an elongated drive portion connected with said lower portion of said knife and extending upwardly therefrom and having an upper end connected with said eccentric drive member for rotation relative to said eccentric drive member about a horizontal eccentric axis fixed relative to said drive member and spaced from and parallel to said drive axis, said drive portion being laterally flexible in a plane perpendicular to said eccentric axis so that as said eccentric member rotates about said drive axis said drive portion reciprocates said lower portion of said knife along said axis of reciprocation and flexes laterally to accommodate the horizontal component of motion of said eccentric axis, said drive axis of said eccentric drive member being spaced horizontally in a plane perpendicular to said eccentric axis a substantial distance from said reciprocation axis so that the deflection of said drive portion during its downstroke is different from its deflection during its upstroke.

2. A reciprocating knife cutter as defined in claim 1 further characterized by means for driving said eccentric drive member about said drive axis in such a direction that during the downstroke of said drive portion said drive portion flexes to a lesser degree than it does during its upstroke.

3. A reciprocating knife cutter as defined in claim 1 further characterized by said lower portion of said knife and said drive portion being made of one piece.

4. A reciprocating knife cutter as defined in claim 3 further characterized by said means for connecting said drive portion to said eccentric member being a chuck connected to said eccentric member for rotation relative thereto about said eccentric axis, said chuck including means for releasably connecting to it said upper end of said drive portion.

5. A reciprocating knife cutter as defined in claim 4 further characterized by said drive axis being horizontally spaced from said reciprocation axis by a distance equal to approximately one half of the distance by which said eccentric axis is spaced from said drive axis.

* * * * *